United States Patent [19]

Lamendour

[11] 4,055,066

[45] Oct. 25, 1977

[54] AUTOMATIC MACHINE FOR BENDING SHEET MATERIAL

[76] Inventor: André Lamendour, Rue Gustave Zede, Z.I. de Kergonan, 29200 Brest, France

[21] Appl. No.: 674,314

[22] Filed: Apr. 7, 1976

[30] Foreign Application Priority Data

Apr. 16, 1975 France ..... 75.11837

[51] Int. Cl.[2] ..... B21D 5/00

[52] U.S. Cl. ..... 72/306; 72/323; 72/388

[58] Field of Search ..... 72/306, 310, 312, 316, 72/319, 320, 323, 322, 379, 380, 381, 384, 386, 387, 388, 321, 322, 460, 477

[56] References Cited

U.S. PATENT DOCUMENTS

| | | | |
|---|---|---|---|
| 2,487,966 | 11/1949 | Engel | 72/380 |
| 3,251,208 | 5/1966 | Mittermaier | 72/319 |
| 3,913,370 | 10/1975 | Break | 72/319 |

FOREIGN PATENT DOCUMENTS

| | | | |
|---|---|---|---|
| 183,296 | 9/1955 | Austria | 72/319 |
| 596,203 | 7/1924 | France | 72/320 |
| 139,445 | 4/1903 | Germany | 72/323 |
| 23,749 of | 1897 | United Kingdom | 72/319 |
| 198,719 | 6/1923 | United Kingdom | 72/319 |

*Primary Examiner*—Michael J. Keenan
*Attorney, Agent, or Firm*—Bucknam and Archer

[57] ABSTRACT

Apparatus for forming bends in the sheet material and including a bending unit with a fixed frame, female holding means for clamping the sheet in a vertical alignment, mobile tables for bending the sheet, which tables rotate on an axis parallel to the longitudinal axis of the apparatus on respective intermediary supports. Each intermediary support is independently moveable on the fixed frame from one position corresponding to a retracted position of the table to a second position which is a working position of the table. The intermediary supports and tables are independently operable.

14 Claims, 3 Drawing Figures

AUTOMATIC MACHINE FOR BENDING SHEET MATERIAL

This invention pertains to an automatic apparatus for forming bends in sheet metal or any other deformable material, and particularly sheet metal of large dimensions.

The conventional apparatus which are widely used at present for forming corrugations or bends in sheet metal are adapted to form only sheets having uniform corrugations. Moreover if non-uniform or non-parallel corrugations or bends varying in spacing from one end of the sheet to the other are required, it becomes necessary to insert the sheet metal into the press brake machine to form a bend in one direction, and then to remove the sheet from the machine in order to turn it over to form another bend in the sheet in the opposite direction. And this process must continue until the proper number of bends has been formed in sheet metal.

It is an object of this invention to provide an automatic apparatus for forming non-parallel or non-uniform bends in sheet of deformable material of large dimensions without the necessity of removing it from the machine and turning it over between successive corrugations or bends.

It is also an object of this invention to provide an automatic apparatus for forming bends at an angle greater than 90°.

The accompanying drawings represent an apparatus enabling the formation of bends through 135° when operating one bending table, as well as the formation of bends through 180° when operating the second bending table, without removing sheet metal from the machine.

It is a further object of this invention to provide an automatic apparatus for forming bends in deformable material of any length by adding such like units to deform or corrugate sheet metal of any desired length.

It is also an object of this invention to provide an apparatus for bending sheet material that can be easily and completely automatized.

Therefore the invention provides an automatic apparatus for forming bends in deformable material and in particular sheet metal of large dimensions, comprising at least one bending unit, whose outstanding characteristic is that it is made up of a fixed frame 5, means for upholding and clamping sheet metal in a somewhat vertical alignment, mobile tables for bending sheet are set out lengthwise on either sides of the sheet metal to bend it in one direction or in the other. It will be noticed that these tables rotate on an axis that is parallel to the longitudinal axis of the apparatus, on arms journalled in bearings on the fixed frame 5 for rotation around an axis that is parallel to the longitudinal axis of the machine. In addition a number of connecting rods and hydraulic jacks are to operate the above mentioned arms and tables for bending sheet metal.

Since the construction and operation of hydraulic cylinders are so well known, and also since the hydraulic system per se is not within the scope of the present invention, a detailed discussion of the hydraulic system is not thought to be necessary; and further, the fluid lines connecting the hydraulic cylinders with the source of hydraulic fluid have been eliminated from the drawings in the interest of clarity.

The lay-out of the bending tables on either side of the sheet metal to be deformed allows the formation of bends in contrary directions without the necessity of turning over the sheet metal.

It is another characteristic of the apparatus to comprise several bending units laid out in a line and mechanically connected one to the other by the bending tables and by the means for clamping sheet metal that have been mentioned above. This set up allows the apparatus to be either lengthened or shortened to deform material of different lengths in the easiest way.

Other objects and advantages of this invention will become apparent from the following description taken in connection with the accompanying drawings.

Figure 1:
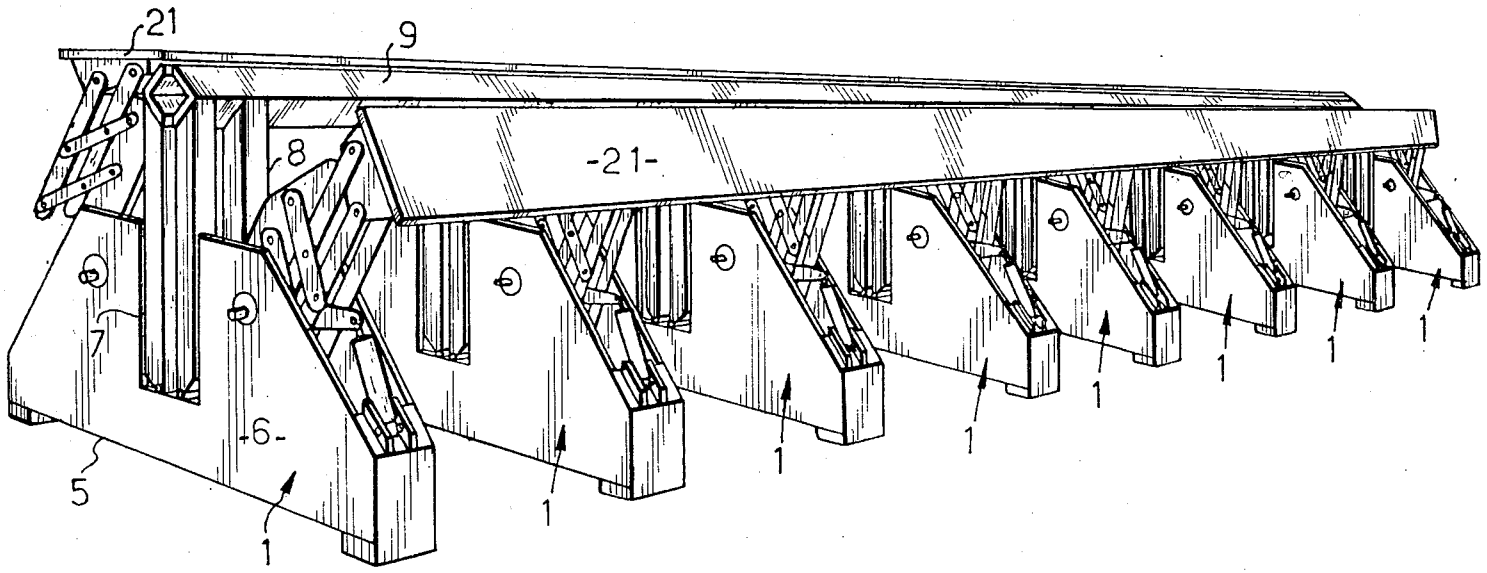
FIG. 1 shows a drawing in perspective of the metal bending apparatus of this invention showing the different bending units in the position which they normally occupy when the machine is not in operation.

The bending apparatus shown in FIG. 1 comprises a certain number of bending units 1; there are eight of them lined up along the longitudinal axis of the machine which makes it very easy to deform or bend any very large sheet metal.

Figure 2:
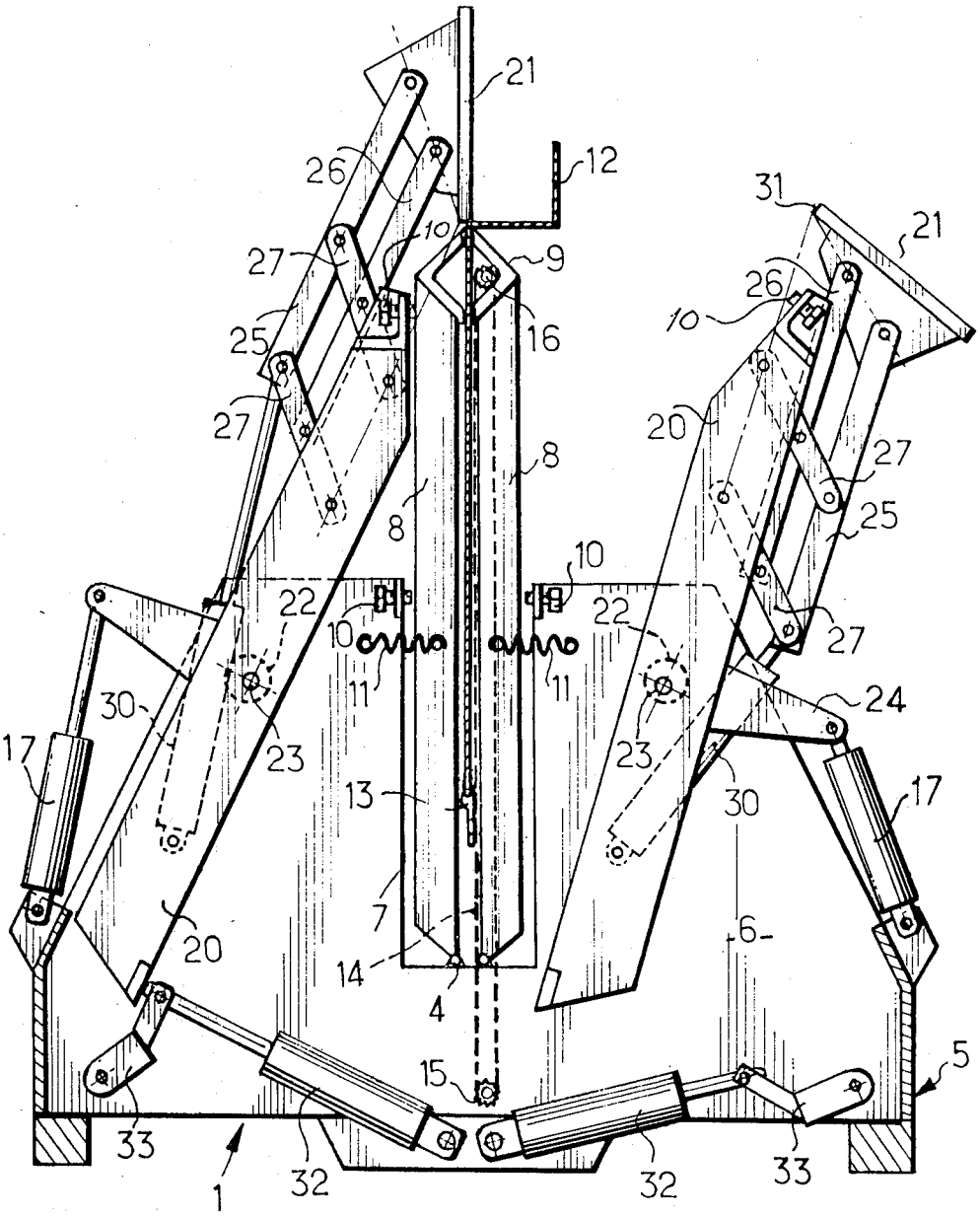
FIG. 2 is a front view of one of the bending units that make up the apparatus shown in FIG. 1.

FIG. 2 is a detailed drawing of each bending unit. Each unit comprises a fixed frame 5 formed by two parallel plates joined together and having a U-shape 7 as illustrated in this sectional view of the bending unit.

On the fixed frame 5 are secured poles 8 somewhat vertically and set in the swan-necks 7 of plates 6 whose lower extremities are connected with joints. The poles 8 are reciprocally mounted and at their upper ends are connected iron sections 9 that extend the whole length of the machine and are at right angles to the poles 8, as illustrated in FIG. 1. Adjustable bumpers 10 are secured in plate 6 of frame 5 to provide means for controlling the extent to the two vertical poles may pivot from one side to the other in a somewhat vertical alignment, and also the extent to which the reaction when bending sheet metal will be convoyed to frame 5.

Furthermore, the poles 8 are freely mounted on joints situated in their lower extremities 4 and each of them is provided with return-springs 11 when clamping shoes are open.

The sheet metal 12 to be deformed will be held in the clamping space formed between the horizontal iron sections 9 and the clamping poles 8 as shown in FIG. 2. The lower part of the sheet metal to be deformed will rest on a movable hook 13 chain-driven in between a lower pulley 15 bolted to the frame and an upper-pulley 16 positioned inside one of the clamping shoes.

In a bending machine of this type wherein a sheet of deformable material is to be raised or lowered in the clamping space all the hooks 13 of the bending units 1 of the machine are driven vertically by a driving-plate-pin operating all pulleys 15.

The frames 5 of each bending unit also bear pivoting arms 20 which in their turn support bending tables 21 that extend the whole length of the machine on either side of the sheet metal 12 to be deformed.

The arms 20 of tables 21 are mounted hinged on frame 5, by means of an eccentric rod 22 common to all the arms 20 that are on the same side of the machine. A hydraulic jack 17, whose cylinder-back is linked to frame 5 and whose piston-rod is linked to a bracket 24 forming one piece with the arm 20, allows arm 20 to pivot round an axis 23 of the eccentric of the rod 22.

Each table 21 is mounted on its arms 20 by means of a set of connecting rods forming a parallel motion linkage and comprising two parallel rods 25 and 26 whose upper ends are hinged with the arms of table 21 while the other ends are linked to two parallel rods 27 whose ends are hinged with arms 20. The lower end of rod 25 is linked to the piston rod of a double acting hydraulic jack 30 whose cylinder-back is mounted hinged on the corresponding arm 20. It will be noticed that the axes that run through the hinges of rods 27 on arms 20 and through the hinges of rods 25 and 26 on the arms of tables 21 meet in line 31 acting as an axis around which table 21 rotates. It will be appreciated that this line 31 extends along the lower edge of the plate forming table 21.

Finally frame 5 also bears two double acting hydraulic jacks 32 symmetrically mounted in relation to the median longitudinal plane of the machine, the cylinder of each jack 32 being linked to the frame 5 while the end of its piston-rod is hinged with a bent casting 33 whose other end is linked to frame 5 around a parallel axis to the longitudinal axis of the machine. The end of piston rod of jack 32 is meant to rest against the lower part of arm 20 as shown in left section of FIG. 2.

Figure 3:
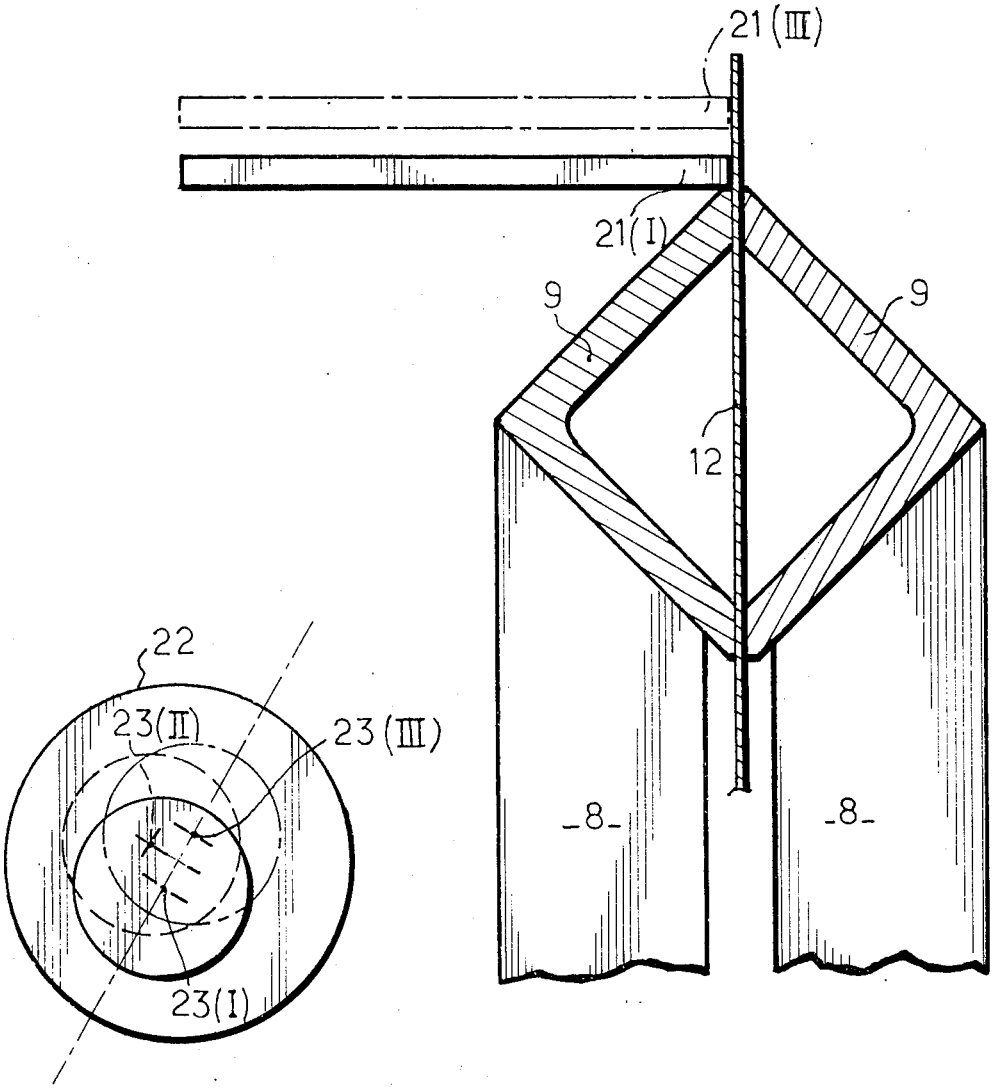
FIG. 3 shows the way in which the movable arms of the bending tables work as well as the different positions these parts may have in relation to the means for clamping the sheet metal in the apparatus according to the invention.

FIG. 3 is a view of an enlarged scale of the different positions of rotation of eccentric rod 22 with bearing arms 20 of mobile tables 21 pivoting around it. The rotation of eccentric rod 22 round its axis secures the vertical motion of arms 20 and their corresponding tables 21 with respect to poles 8 and their horizontal iron section 9 for clamping sheet metal. FIG. 3 shows in 23 (I) the lower position the eccentric of rod 22 can have. It will be noted that it corresponds to the lower position 21 (I) of table 21. Diagram 23 (II) shows the intermediate position of eccentric of rod 22. Drawing 23 (III) represents an upper position of the eccentric corresponding to an upper position 21 (III) of mobile table 21 with respect to iron sections 9 for clamping sheet metal.

The operation of the apparatus as described above is thought to be reasonably self-evident; however a brief description of the operation may be in order.

When the machine is not operating the two mobile tables 21 and the arms 20 supporting them are found in a position represented in FIG. 1. The poles 8 for clamping sheet metal are drawn back by means of return springs 11 so that the horizontal iron sections 9 acting as clamping shoes are open and space is provided for sheet metal. A sheet metal 12 can be brought vertically in between poles 8 forming a clamping space. The lower parts of sheet metal 12 will rest on hooks 13 fastened to chain 14. It is for instance feasable to set hooks 13 as low as possible so that the sheet metal 12 will be sunk as much as possible inside clamping space. By acting on the driving-plate-pin of pulleys 15 in the upward direction all hooks 13 will be raised simultaneously so that the desired length of sheet metal overhangs the horizontal iron sections 9 of clamping shoes. When operating double acting hydraulic jack 17 jointed to arms 20 supporting bending tables 21 all the arms 20 are brought to press against poles 8 as is exemplified in the left-hand side of FIG. 2. In addition it is possible to push with a determined force arms 20 against poles 8 by means of hydraulic jacks 32, so that poles 8 pivot round their hinges 4 until they are propped against bumpers 10 (these are seen on the left-hand side of diagram in FIG. 2), thereby transmitting the reaction to frame 5 of each bending unit. Simultaneously the clamping of sheet metal 12 is secured in between iron sections 9. By means of hydraulic jacks 30 it is then possible to have corresponding tables 21 pivot round the above mentioned axis 31 in order to bend the part of sheet metal overhanging clamping iron sections 9. The size of the angle according to which table 21 has been turned from its horizontal position determines the size of the angle of the bend of the said overhanging part of sheet metal 12. The size of the angle can vary from 0° to 135° or thereabouts with a machine of the type represented in the accompanying drawings. It will be further noticed that table 21 bends sheet metal 12 by means of its longitudinal side section.

When the process of bending sheet metal is over, hydraulic jacks 32 and 17 are operated. As a consequence bending tables 21 and the arms 20 supporting them are drawn back from poles 8 and sheet metal 12. Poles 8 are therefore released and they are pulled back to their initial position by means of return-springs 11.

By means of the second bending table 21, which is found on the other side of sheet metal 12, it is then possible to form another bend in a contrary direction to the first one. To form this bend, hooks 14 must be cranked up in order to raise sheet metal 12, with respect to iron sections 9 forming clamping shoes, and then hydraulic jacks 32, 17 and 30 must be operated as above mentioned to bend sheet metal in a contrary direction.

The rotation of eccentric rod 22, as previously mentioned and exemplified in FIG. 3, makes it possible to slightly lower or raise the axis of rotation of mobile tables 21, with respect to horizontal iron sections 9. The rotation of eccentric rod thus enables the apparatus to bend sheet metal of varying thicknesses and to form bends at any size of angle.

The machine also allows folds or pleats to be formed in sheet metal. To form such folds or pleats the machine must be operated in the following way. By means of one of the bending tables 21, a first bend through an angle of 135° can be formed in sheet metal 12 for example. Once this bend has been formed, poles 8 are unclamped and sheet metal 12 is cranked up to a height that is somewhat equal to that of the bend already formed. As examplified in left hand side of FIG. 2, bending table 21 which has just been in operation is maintained in a vertical position alongside the overhanging sheet metal 12 which rests against table 21 during the second operation. The second bending table 21 is then brought to press vertically against the other bending table thereby flattening the bend already formed through an angle of 180°.

The apparatus according to the invention thus allows to deform any kind of sheet metal and to form any kind of bend by means of appropriate motions of bending tables 21 and of hooks 13.

It will be noticed that the different movable parts of the machine lend themselves particularly well to the complete automatization of the machine.

While there has been shown and described a preferred embodiment of the apparatus of this invention, it will be understood that many changes and alterations may be made thereto without departing from the scope of the invention. Accordingly this invention is not to be considered as limited to the specific embodiment described but rather is limited only in accordance with the appended claims.

What I claim is:

1. An apparatus for forming bends in deformable sheet material and comprising at least one bending unit, whose outstanding characteristic is that it is made up of a fixed frame, female means for upholding and clamping sheet material in a somewhat vertical alignment, the upper edge of said female means being parallel to the longitudinal axis of the apparatus, mobile tables for bending sheet material and set out lengthwise on either side of the sheet material to bend it in one direction or in the other, said tables rotating on an axis that is parallel to the longitudinal axis of the apparatus on respective intermediary supports, each of which are independently movable on the fixed frame from a first position corresponding to a retracted position of the table to a second position corresponding to a working position of the table, and respective means for independently operating said intermediate supports and said tables for bending sheet material.

2. The apparatus according to claim 1 including a plurality of bending units laid out in a line and mechanically connected one to the other by the bending tables and by said means for clamping sheet metal.

3. The apparatus according to claim 1 wherein said means for clamping sheet material comprise poles, in a somewhat vertical alignment, reciprocally mounted and jointed to the frame, these poles having their upper ends made up of horizontal iron sections extending the whole length of the machine intended for the clamping of sheet material overhanging in a somewhat vertical alignment in between said poles.

4. The apparatus according to claim 3 wherein each set of said poles pivot between two extreme positions determined by adjustable bumpers bolted to frame and transmitting to the latter the reaction when clamping and bending sheet metal, said poles being mounted hinged on frame and pivoting around an axis parallel to the longitudinal axis of the machine.

5. The apparatus according to claim 3 wherein said means for upholding sheet material in a somewhat vertical alignment comprise hooks moving vertically in between said poles with sheet material resting on them and being vertical driven in between horizontal iron sections forming clamping shoes of said poles.

6. The apparatus according to claim 5 wherein said hooks are fastened to a chain driven in between a lower pulley loosely bolted to the frame and an upper pulley positioned inside one of said poles, the two pulleys being in somewhat vertical alignment.

7. The apparatus according to claim 3 wherein said poles are provided with return springs acting as means for pulling them back, thereby unclamping sheet material resting on hooks in clamping space.

8. The apparatus according to claim 7 wherein arms supporting bending tables are made up of iron sections mounted jointed to fixed frame and pivoting around an intermediate point while supporting a bending table by means of a set of rods forming a motion parallelogram, one side of which is constituted by the table.

9. The apparatus according to claim 8 wherein one or several double-acting hydraulic jacks are secured between each arm and its corresponding table transmitting motion to said table which pivots around a horizontal axis parallel to the axis of the machine.

10. The apparatus according to claim 8 wherein arms of each table are set in rotary motion by means of a first set of double acting hydraulic jacks, said arms moving in between two extreme positions, the first one corresponding to the position of the table when bending sheet material, the second to the position of the bending table when not in operation.

11. The apparatus according to claim 8 wherein said arms are mounted hinged on an eccentric rod, the rotation of which allows said arms and their corresponding tables to be raised with respect to said poles and their horizontal iron sections for clamping sheet material.

12. The apparatus according to claim 8 wherein either of the two bending tables can be operating independently one of the other so that sheet material can be sent in contrary directions, or again sheet material can be sent through 135° by operating one bending table, and next through 180°, flat on itself, by operating the second bending table.

13. The apparatus according to claim 8 wherein one of the two bending tables bends sheet material along a line extending the whole length of the apparatus, a line that is just above the level of iron sections forming clamping shoes so that sheet material takes its bearing on iron sections when it is in the process of being bent.

14. The apparatus according to claim 1, wherein each of said intermediary supports is constituted by an arm bearing on the fixed frame around an axis that is parallel to the longitudinal axis of the machine, said female means comprising poles, in a somewhat vertical alignment, reciprocally mounted and joined onto the frame, so that they can move between two extreme positions determined by thrusts of the frame, which poles having their upper ends made up of horizontal iron sections extending over the entire length of the machine intended for the clamping of sheet material overhanging in a somewhat vertical alignment in between said poles, each of said arms, when brought into first position, being pressed against the adjacent pole, by control means whereby sheet material is clamped by said iron.

* * * * *